US007220091B2

(12) United States Patent
Takahashi et al.

(10) Patent No.: US 7,220,091 B2
(45) Date of Patent: May 22, 2007

(54) FASTENING NUTS WITH LOOSENING ASSIST FUNCTIONS

(75) Inventors: Yuuji Takahashi, Anjo (JP); Sinsuke Mori, Anjo (JP); Tooru Horiyama, Anjo (JP); Sinji Hirabayashi, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 11/115,227

(22) Filed: Apr. 27, 2005

(65) Prior Publication Data

US 2005/0254919 A1 Nov. 17, 2005

(30) Foreign Application Priority Data

Apr. 28, 2004 (JP) ..... 2004-133709

(51) Int. Cl.
*F16B 37/08* (2006.01)

(52) U.S. Cl. ..... 411/432; 411/265

(58) Field of Classification Search ..... 411/432, 411/433, 265

See application file for complete search history.

(56) References Cited

U.S. PATENT DOCUMENTS 4,850,154 A * 7/1989 Grammer et al. ..... 451/548
4,941,790 A * 7/1990 Kirn ..... 411/432
5,042,207 A * 8/1991 Kirn ..... 451/342
5,175,963 A * 1/1993 Schafer et al. ..... 451/342
5,177,905 A * 1/1993 Takahashi et al. ..... 451/342
5,388,942 A * 2/1995 Bonacina et al. ..... 411/432
6,149,364 A * 11/2000 Maeda ..... 411/432
6,273,659 B1 * 8/2001 Goto ..... 411/432
6,887,018 B2 * 5/2005 Ostermeier ..... 408/204

FOREIGN PATENT DOCUMENTS

JP 4-118972 10/1992
JP 04-118972 U 10/1992

* cited by examiner

*Primary Examiner*—Robert J. Sandy
*Assistant Examiner*—Jeffrey A. Sharp
(74) *Attorney, Agent, or Firm*—Oliff & Berridge, PLC

(57) ABSTRACT

A fastening nut includes an operation member, a female threaded member, and a control device. The operation member is operable by an operator to rotate in a fastening direction and a loosening direction. The control device is coupled between the operation member and the female threaded member and includes a plurality of movable members, such as nut segments and wedge members, and a plurality of control members, such as rollers and balls. The movable members are arranged in a circumferential direction about the nut axis. Each movable member is movable between a first position and a second position. The first positions enables fastening of the female threaded member onto the male threaded member. The second position enables loosening of the female threaded member. The control members either prevent or allow the movement of each movable member from a first position to a second position.

30 Claims, 13 Drawing Sheets

FASTENING NUTS WITH LOOSENING ASSIST FUNCTIONS

This application claims priority to Japanese patent application serial number 2004-133709, the contents of which are incorporated herein by reference.

BACKGROUND OF THE INVENTION

1. Field of the Invention

The present invention relates to fastening nuts, such as nuts for fastening grinding wheels to the spindles of portable grinders. In particular, the present invention relates to fastening nuts with loosening assist functions for facilitating the loosening of the nuts via application to the nuts of small loosening forces.

2. Description of the Related Art

In general, a fastening nut is engaged with and fastened onto a male thread formed on a front end of a spindle in order to mount a disk-like grinding wheel to a motor-driven spindle of a portable grinder. The grinding wheel is mounted so as to not move in an axial direction or also in a rotational direction relative to the spindle. The grinding wheel can be clamped between the nut and a flange formed on the spindle so as to not move in an axial direction or in a rotational direction.

In this kind of grinder, the resistance force applied to the grinding wheel by a workpiece during a grinding operation may act to further fasten (i.e., tighten) the nut. Therefore, it is often difficult to loosen the nut in order to remove the grinding wheel from the spindle. In order to solve this problem, various measures have been proposed in the art.

For example, U.S. Pat. No. 5,175,963 (corresponding to Japanese Patent No. 2801324) teaches a fastening nut in which steel balls are provided. The steel balls maintain a state where wedge members, disposed at tri-sectional positions about a male threaded portion of a spindle, are fitted between a grinding wheel and a nut body fastened onto the male treaded portion. The steel balls can maintain the fastened condition of the nut body onto the male threaded portion. According to this type of fastening nut, rotation of an operation ring containing recesses, formed in the inner circumference of the operation ring for receiving the steel balls, allows the steel balls to move into the recesses and become displaced radially outward. Consequently, the wedge members are moved in directions for facilitating removal from positions between the nut body and the grinding wheel. Therefore, this operation enables a relatively small operational force to loosen the nut body, which has been fastened onto the male threaded portion of the spindle.

Japanese Laid-Open Utility Model publication No. 4-118972 teaches a fastening nut in which steel balls are respectively disposed between an operation ring and nut segments that correspond to tri-sectional segments of a nut about a male threaded portion of a spindle. The steel balls can be moved into recesses formed in the nut segments so as to displace the nut segments in radially outward directions. The nut segments fastened onto the male threaded portion of the spindle can then be loosened.

Throughout the specification, the term "radial direction" in relation to the movement of the nut segments is used to indicate the radial direction about an axis of a male threaded portion (or female threaded portion) to which a nut is fastened. Therefore, the term "radially outward direction" is used to indicate a direction away from the axis of the male threaded portion. The term "radially outward direction" is used to indicate a direction towards the axis of the male treaded portion.

However, in the case of the former type of fastening nut incorporating separated wedge portions, a single steel ball is engaged with and released from each of the corresponding wedge portions. Similarly, in the case of the latter type of fastening nut incorporating nut segments, a single steel ball is engaged with and released from each of the corresponding nut segments. Therefore, there exists a problem in that the positions of the wedge portions or the nut segments are liable to become unstable, particularly when the nut is fastened.

SUMMARY OF THE INVENTION

It is accordingly an object of the present invention to teach improved fastening nuts that can be easily loosened, for example, in order to remove a grinding wheel from a grinder. Additionally, an object of the present invention is to teach improved fastening nuts that can exert a stable fastening force when the nuts used for fastening.

In one aspect of the preset teachings, fastening nuts are taught that include an operation member, a female threaded member, and a control device. The operation member is operable by an operator so as to rotate in a fastening direction and a loosening direction. The control device is coupled between the operation member and the female threaded member. The control device includes a plurality of movable members, such as nut segments and wedge members for example, and a plurality of control members, such as rollers and balls for example. The movable members are arranged in the circumferential diction about the axis of the nut. Each movable member is movable at least between a first position and a second position along a radial direction from the axis of the nut. The first position enables the fastening of the female threaded member onto the male treaded member. The second position enables the loosening of the female threaded member. The control members are interposed between the operation member and each of the corresponding movable members. The control members prevent the movement of the movable members from a fist position to the second position when the operation member rotates in a fastening direction. On the contrary, the control members permit the movement of the movable members from the first position to a second position when the operation member rotates in a loosening direction.

Therefore, each movable member may reliably be held in a first position by the plurality of the control members. As a result, the fastening nut can be reliably fastened onto the male threaded member via a relatively strong force.

In another aspect of the present teachings, fastening nuts are taught that include a base, a cover, a plurality of nut segments, and a corresponding plurality of control members. The base has a first insertion hole for receiving the male threaded member. The cover has a second insertion hole for receiving the male treaded member and also includes a circumferential wall. Together the nut segments comprise a virtual single nut. The nut segments are arranged at regular intervals in a circumferential direction about the central axis of the virtual single nut. The nut segments are disposed between the base and the cove and are movable in a radial direction about the axis of the nut. The control members are disposed between each nut segment and the circumferential wall of the cover in order to prevent each nut segment from moving in a radially outward direction with respect to the nut axis. Relief recesses are formed in the circumferential wall of the cover and/or in each nut segment. The relief recesses are engageable with the corresponding control members to permit each nut segment to move in the radially outward direction when the cover has rotated in a nut loosening direction relative to the base. A loosening assist function is therefore affected to reduce the fastening force applied by each nut segment onto the male dreaded member.

With this configuration, the radially outward movement of each nut segment is prevented by the plurality of control members. Therefore, the position of each nut segment in the radial direction with respect to the nut axis can be more reliably maintained in comparison with the shown fastening nut, in which the radial movement of each nut segment is restricted by a single control member (i.e., a single steel ball) in order to provide a loosening assist function. Therefore, the fastening nut of the current invention can be reliably fastened onto the male threaded member via a relatively strong force.

In one embodiment, the fastening nuts further include an auxiliary member disposed at least between two adjacent control members for each nut segment. The auxiliary member functions in part to keep a minimum distance between the control members. With this arrangement, it is possible to clearly distinguish the engaging condition of the control members with the relief recesses and the disengaging condition of the control members from the relief recesses.

In another embodiment, the fastening nuts further include at least one spring that normally biases the cover in a nut fastening direction relative to the base. Therefore, when the cover is rotated in the nut fastening direction in order to perform a fastening operation, the cover and the base may rotate together in the nut fastening direction. On the contrary, when the cover is rotated in the nut loosening direction in order to perform a loosening operation, the movement of the cover precedes the movement of the base in the nut loosening direction. After the control members engage the relief recesses, the nut segments can then move in the radially outward direction to enable the loosening of the fastening nut from the male treaded member via a relatively small force.

In a further embodiment each of the control member is configured as a cylindrical roller that has a longitudinal axis extending substantially parallel to the nut axis. With this arrangement, it is possible to mare stably restrain the radially outward movement of tire nut segments in comparison with using known control members configured as balls.

In a still further embodiment, the fastening nuts further include a stopper device that permits iron of the male threaded member of the spindle from tike base side of the fastening nut and prevents the insertion of the male threaded member from the cover side of the fastening nut. Therefore, the fastening nuts can be reliably fastened onto the male threaded member without permitting improper insertion from the cover side of the fastening nut. As a result, the loosening assist function can be readably implemented.

In a still further embodiment, the fastening nuts further includes a seal device interposed between adjacent nut segments positioned in a circumferential direction. Therefore, foreign particles may not be allowed to enter into the space between the nut segments and the circumferential wall of the cover. As a result, the smooth movement of the control members can be ensured, enabling the performance of the given function of the fastening nuts.

Preferably, the seal device includes a seal member with a pair of ring portions, and a plurality of connecting portions connecting between the ring portions. The ring portions and the connecting portions may be formed integrally with each other. One of the ring portions is clamped between the base and the various nut segments. The other of the ring portions is clamped between the cover and the nut segments. Each of the connecting portions is clamped between two adjacent nut segments in the circumferential direction. With this configuration, in addition to providing a seal between the nut segments, it is possible to provide a seal between the base and the nut segments and a seal between the cover and the nut segments. In addition, the handling and the assembling of the seal member to the fastening nut can be facilitated.

In a further aspect of the present teachings, fattening nuts are taught that include a nut body, a pressing flange, a plurality of wedge members, an operation member, and a plurality of control members, The nut body includes a female portion and a flange portion. The flange portion extends radially outward from one axial end of the female threaded portion. The pressing flange is disposed so as to oppose the flange portion of the nut body. The pressing flange is movable in an axial direction relative to the nut body. The wedge members are arranged at regular intervals in a circumferential about the nut axis. Each wedge member is interposed between the pressing flange and the flange portion of the nut body in order to affect a wedging function. The operation member has a circumferential wall that is disposed on the outer peripheral side of the wedge members and encloses the flange portion of the nut body and the pressing flange. The control members are interposed between the operation member and each wedge member in order to prevent each wedge member from moving in the radially outward direction. A plurality of relief recesses are formed in either the circumference wall of the operation member or in each wedge member. The relief recesses are respectively engageable with the control members corresponding to each wedge member. The control members for each wedge under are disengaged from the relief recesses in order to position each wedge member in a radially inward position for implementing the wedge function when the operation member is in a fist position on the side of a nut fastening direction. On the contrary, the control members for each wedge member are engaged with the relief recesses in order to permit each wedge member to move radially outward from the radially inward position for releasing the wedge function when the operation member is rotated from the first position in a nut loosening direction, which is opposite to the nut fastening direction.

With this arrangement, in order to instill the fastening nut onto the male threaded member, the male threaded member may be inserted into and engaged with the female threaded portion from the side of the pressing flange of the fastening nut. The operation member may then be rotated in the fastening direction. As long as the operation member is rotated in the fastening the control members are positioned so as to not engage with the relief recesses, restraining the movement of the wedge members in the radially outward direction. The pressing flange is held in a position away from the flange portion of the nut body. Therefore, the fastened condition of the fastening nut may be locked as the operation member is further rotated in the nut fastening direction after the pressing flange has contacted with the fastened object. On the contrary, in the event that the operation member is rotated in the loosening direction, the control members may be brought so as to engage the relief recesses, enabling the movement of the wedge members in the radially outward direction. The pressing flange can move axially toward the flange portion of the nut body, releasing the fastened condition of the fastening nut.

In particular, the radially outward movement of each wedge member is prevented by the plurality of control members. Therefore, the position of each wedge member in the radial direction with respect to the nut axis can be reliably maintained in corrosion with the known fastening nut in which a corresponding single control member (i.e., a steel ball) restricts the radial movement of each wedge member. Consequently, the fastening nut of the current invention can be reliably fastened onto the male threaded member with a strong force.

In one embodiment, the fastening nut further includes an auxiliary member disposed at least between two adjacent control members for each wedge member. The auxiliary member functions to keep a minimum distance between the two control members. In another embodiment, each of the control members may be configured as a cylindrical roller with a longitudinal axis extending substantially parallel to the nut axis.

In a further embodiment, the fastening nut further includes at least one spring that normally biases the operation members in the nut fastening direction relative to the flange.

In a further aspect of the present teachings, rotary tools are taught that include the fastening nut of the various aspects listed above. Therefore, the fastening nut can be easily loosened even if the nut has been excessively fastened (e.g., over tightened) onto the male threaded member of a spindle due to the resistance a workpiece applies to a rotary device, such as a grinding wheel, during the use of the rotary tool. As a result, the operation for replacing a worn rotary blade with another rotary blade can be easily performed.

In one embodiment, a fastening nut for fastening onto a male threaded member may include a nut body. The nut body may include a female threaded portion defining a nut axis and comprising a first axial end and a second axial end and a flange portion extending radially outward from the first axial end. A pressing flange may be slidingly disposed around a section of the female threaded portion proximate to the second axial end and the pressing flange may oppose at least a section of the flange portion in an axial direction and is slidingly movable relative to the nut body in the axial direction. A plurality of wedge members may be at regular intervals along a circumferential direction about the nut axis and each of the plurality of wedge members is interposed between the pressing flange and the flange portion and an operation member having a circumferential wall may be disposed on an outer circumferential side of the plurality of wedge members and enclosing the flange portion and the pressing flange. The fastening nut may include two control members for each corresponding wedge member of the plurality of wedge members, wherein each of the two control members are interposed between the operation member and the corresponding of wedge member and each of the two control members define a first wedge position for each corresponding wedge member when the operation member is in a first operation position. The fastening nut may include two relief recesses corresponding to each of the two control members and formed in the circumferential wall of the operation member or in each of the corresponding wedge members. Each of the two control members may define a second wedge position for each corresponding wedge member when the operation member is in a second operation position. The second wedge position may be radially outward of the first wedge position to an extent that each of the two control members are engaged with the corresponding two recesses. The first wedge position may fix the pressing flange at a first axial distance from the flange portion. The second wedge position may allow the pressing flange to move to a second axial distance from the flange portion. The first axial distance may be greater than the second axial distance.

DETAILED DESCRIPTION OF THE INVENTION

Each of the additional features and teachings disclosed above and below may be utilized separately or in conjunction with other features and teachings to provide improved fastening nuts and methods of manufacturing such fastening nuts. Representative examples of the present invention, which examples utilize many of these additional feature and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

First Representative Embodiment

Figure 1:
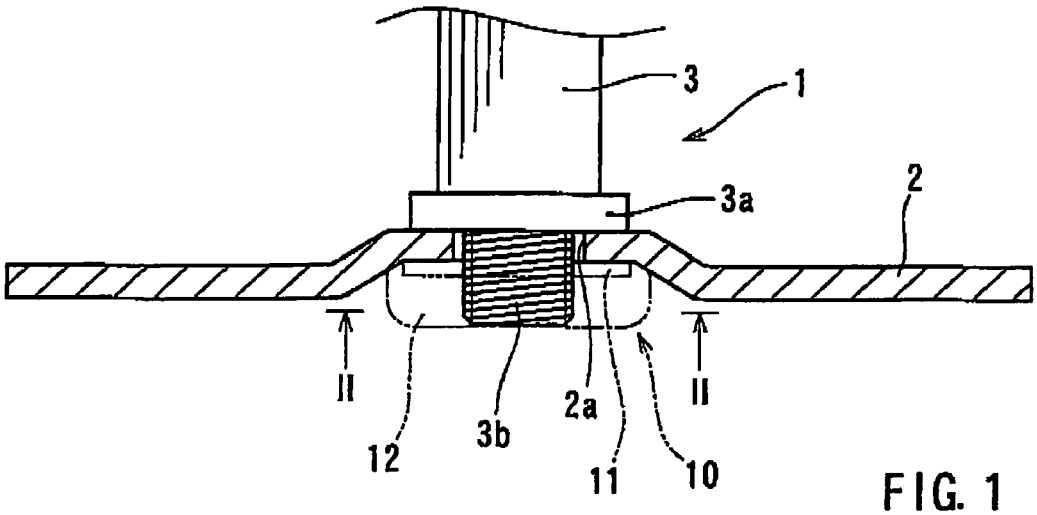
FIG. 1 is a partial schematic view showing the attachment of a grinding wheel to the spindle of a grinder via a fastening nut according to a first representative embodiment of the current invention.

A first representative embodiment of the present invention will now be described with reference to FIGS. 1 to 15. Referring to FIG. 1, a grinding wheel 2 is mounted to a portion of a grinder 1 by utilizing a representative fastening nut 10. The grinder 1 is for example a rotary tool and the grinding wheel 2 is for example a rotary blade. The construction of the grinder 1 itself is known in the art and will not be described in detail. Thus, the grinder 1 may have a tool body (not shown) and a spindle 3 extending from the tool body. The spindle 3 is rotatably driven by an electric motor (not shown) disposed within the tool body. FIG. 1 shows only the spindle 3 portion of the grinder 1.

A flange 3*a* and a male threaded portion 3*b* are formed on the front end of the spindle 3. In this representative embodiment, the male threaded portion 3*b* is configured as a right-hand thread. Therefore, when the fastening nut 10 is engaged with the male threaded portion 3*b*, rotating the fastening nut 10 in a right hand direction (i.e., clock-wise) may securely fastened the fastening nut 10 onto the male threaded portion 3*b*. On the contrary, by rotating the fastening nut 10 in a left-hand direction (i.e., counter clock-wise), the fastening nut 10 may be loosened from a fastened condition with the male threaded portion 3*b*.

The grinding wheel 2 is mounted to the front end of the spindle 3 so as to not move relative to the spindle 3 in both the axial diction and the rotational direction. More specifically, the grinding wheel 2 is fitted onto the male threaded portion 3*b* such that the male threaded portion 3*b* is inserted through a central mounting hole 2*a* farmed in the grinding wheel 2, until one side of the grinding wheel 2 contacts the flange portion 3*a*. In this configuration, the fastening nut 10 is engaged with and fastened onto the male threaded portion 3*b*. The grinding wheel 2 may be removed from the spindle 3 by loosening the fastening nut 10 from the male threaded portion 3*b*. As will be explained later, the representative fastening nut 10 has a function to enable an operator to easily loosen the fastening nut 10 via the exertion of a relatively small force (hereinafter called "loosening assist function"), even if the fastening nut 10 has been excessively fastened. The fastening nut 10 may be excessively tightened as a result of the application of an external force to the fastening nut 10 in a fastening direction due to the resistance applied to the grinding wheel 2 by a workpiece during a grinding operation.

The detailed construction of the fasting nut 10 is shown in FIGS. 2 to 5. The fastening nut 10 includes a disk-like base 11 and a cup-shaped cover 12. In addition, the fastening nut 10 also includes three nut segments 13, three pairs of restriction rollers 14, and three auxiliary rollers 15, assembled between the disk-like base 11 and the cup-shaped cover 12. One pair of the restriction rollers 14 and one of the au rollers 15 are assigned to each one of the nut segments 13. In this specification, the restriction rollers 14 may be referred to as restriction members and the auxiliary rollers 15 may be referred to as auxiliary members.

Figure 7:
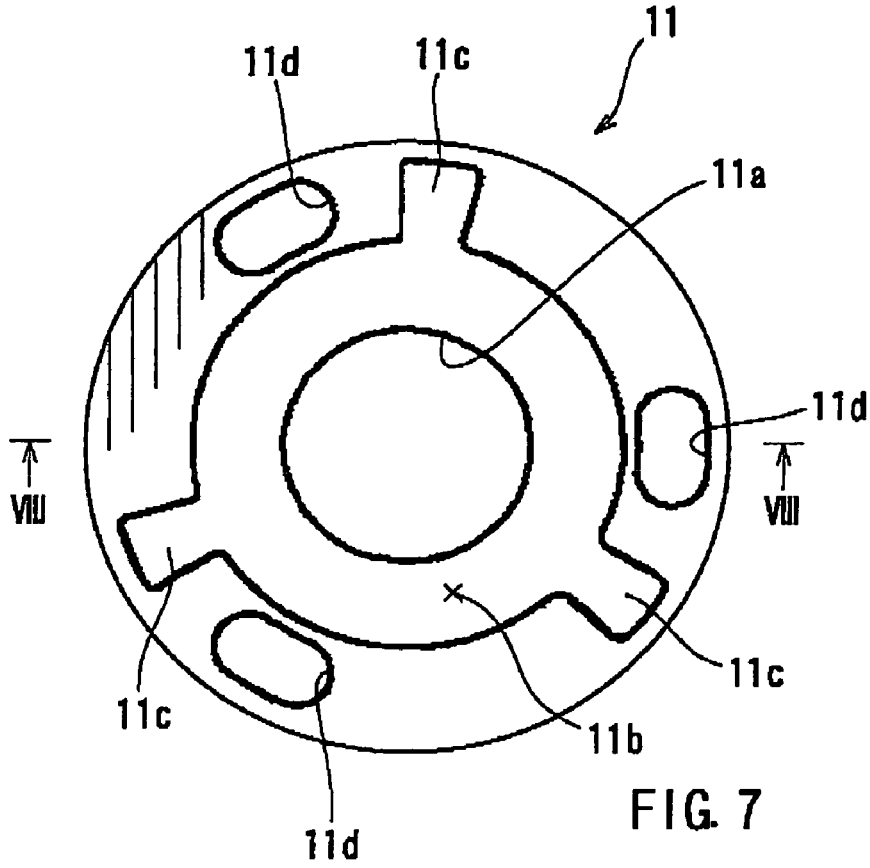
FIG. 7 is a plan view of a base of the fastening nut.
Figure 8:
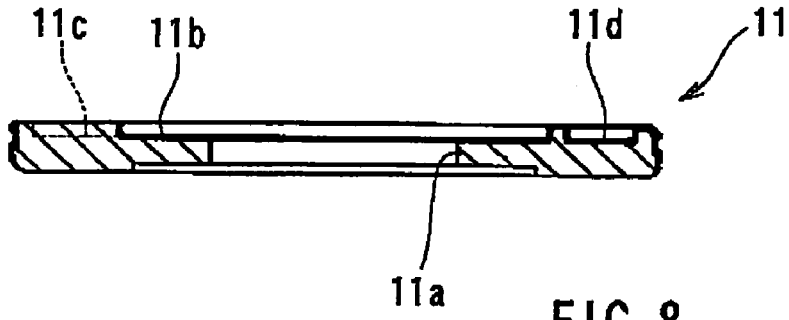
FIG. 8 is a cross sectional view taken along line VIII—VIII in FIG. 7, showing a vertical sectional view of the base.

The base 11 is individually shown in FIGS. 7 and 8. An insertion hole 11*a* is formed centrally of the base 11 in order to permit insertion of the male headed portion 3*b* of the spindle 3. The fastening nut 10 is engaged to the male threaded portion 3*b* with the fastening nut 10 oriented such that the male treaded portion 3*b* is inserted firm the side of the insertion hole 11*a* of the base 11.

An engaging recess 11*b* having a small depth is formed in the inner wall (i.e., the wall on the viewing side of FIG. 7 or on the upper side as viewed in FIG. 8) of the base 11 around the insertion hole 11*a*. Three retaining recesses 11*c*, having the same depth as the engaging recess 11*b*, are formed in series with the engaging recess 11*b*. The retaining recesses 11*c* extend radially outward from the engaging recesses 11*b* at tri-sectional positions along the circumferential direction. In addition, three guide recesses 11*d* are formed in the inner wall of the base 11, also at tri-sectional positions along the circumferential direction. Each of the guide recesses 11*d* is elongated so as to have a predetermined length along an arc about the center of the base 11. The guide recesses 11*d* have a slight depth similar to the engaging recess 11*b* and the retaining recesses 11*c*.

Figure 9:
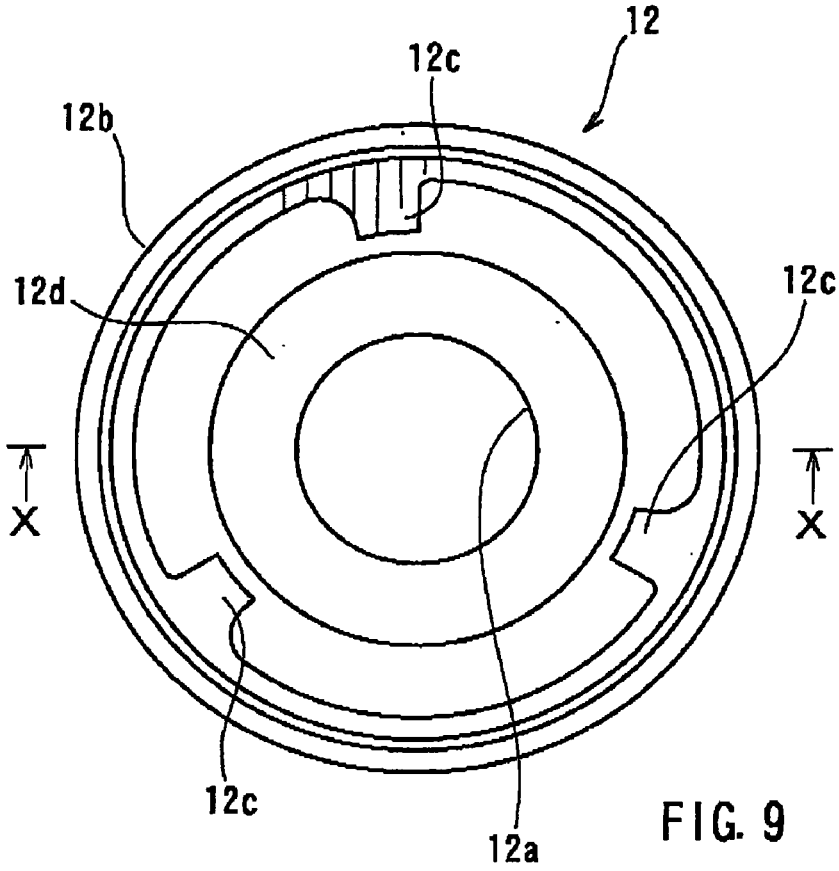
FIG. 9 is a plan view of a cover of the fastening nut, showing the inner side of the cover.
Figure 10:
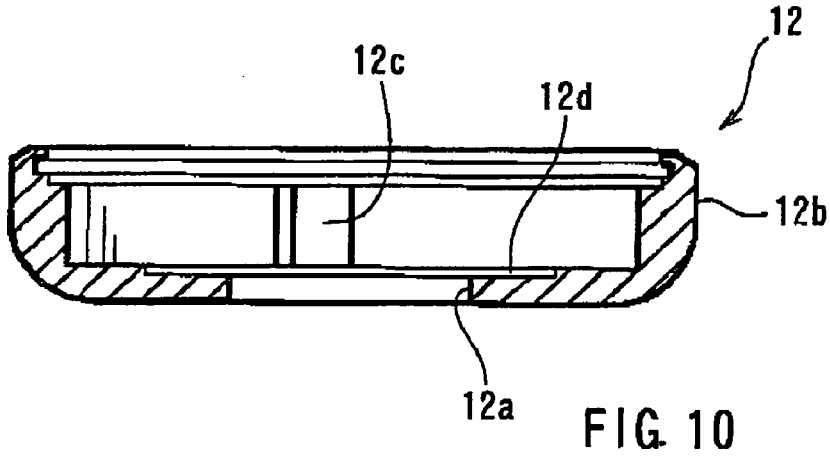
FIG. 10 is a cross sectional view taken along line X—X in FIG. 9, showing a vertical sectional view of the cover.

The cover 12 is individually shown in FIGS. 9 and 10. The cover 12 has a cup-shaped configuration and has an outer diameter that is substantially the same as the outer diameter of the base 11. An insertion hole 12*a*, having substantially the same diameter as the insertion hole 11*a* of the base 11, is formed in the center of the cover 12. Tree engaging projections 12*c* are formed on the inner peripheral surface of a circumferential wall 12*b* of the cover 12 and extend radially inwardly towards the center of the cover 12. Also, the engaging projections 12*c* are positioned at tri-sectional positions along the circumferential direction. An engaging recess 12*d*, having a slight depth, is formed in the cover about the insertion hole 11*a* so as to correspond to the engaging recess 11*b* of the base 11.

Figure 11:
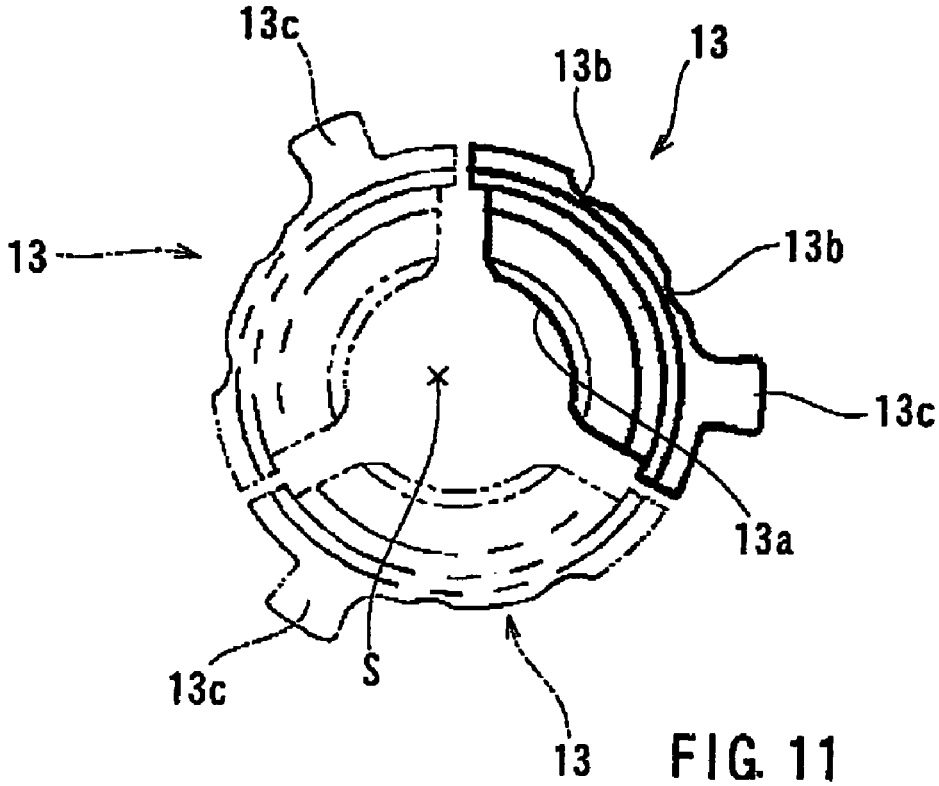
FIG. 11 is a plan view showing the positional relationship of the nut segments of the fastening nut where one of the nut segments is indicated by solid lines and the other two of the nut segments are indicated by chain lines.

The three nut segments 13 are assembled within the cover 12 and are individually represented in FIG. 11. The nut segments 13 correspond to sections of a single complete nut divided at equally spaced tri-sectional positions along the circumferential direction. Therefore, the nut segments 13 all have the same general configuration. The nut segments 13 are arranged in tri-sectional positions along the circumferential direction of the cover 12 to virtually form a single female thread S that is threadably engageable with the male treaded potion 3*b*. The nut segments 13 are positioned so as to oppose the engaging recess 11*b* of the base 11 and to oppose the engaging recess 12*d* of the cover 12. The engaging recess 11*b* and the engaging recess 12*d* permit the nut segments 13 to move a little distance in the radial direction with respect to the center of the female thread S.

Each of the nut segments 13 has a threaded hole part 13*a* at a position corresponding to the inner circumferential side of the female thread S. Each nut segment 13 also includes two relief recesses 13*b* at a position corresponding to the outer circumferential side of the female thread S. Further, each of the relief recesses 13*b* has a sectional configuration corresponding to an arc having a radius, for example such as a radius of about 1.0 mm, in order to enable the engagement of a part of the corresponding restriction roller 14. In addition, an engaging projection 13*c* is formed on the outer peripheral surface in a position adjacent to one end, in the circumferential direction, of each nut segment 13. Each engaging projection 13*c* extends radially outward from the outer peripheral surface so that the engaging projection 13*c* extends radially outward from the engaging recesses 11*b* into the retaining recess 11*c* of the base 11 and the engaging recess 12*d* of the cover 12 in the assembled state. In this way, the threaded hole parts 13*a* of the three nut segments 13 together form the virtual single female thread S. The size and the configuration of the nut segments 13 are determined such that the threaded hole parts 13*a* are always position on the radially inner side of the insertion hole 11*a* of the base 11 and the insertion hole 12*a* of the cover 12, over the entire movable range of the nut segments 13 in the radial direction.

Figure 2:
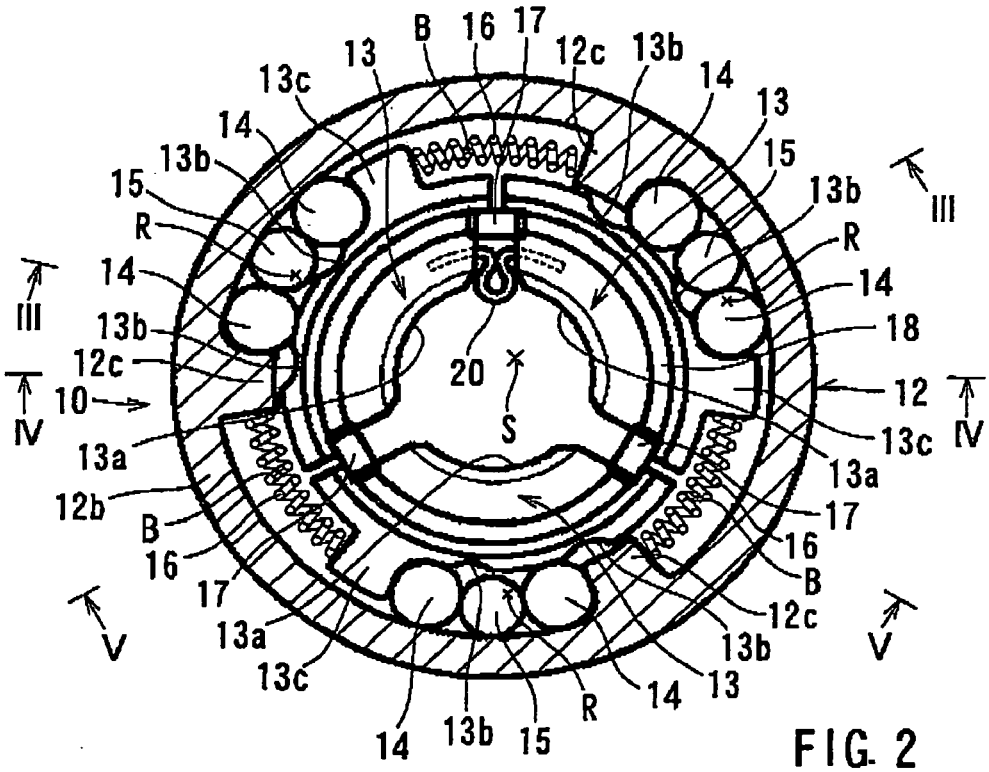
FIG. 2 is an enlarged cross-sectional view taken from the direction indicated by the arrows II—II in FIG. 1, showing the internal structure of the fastening nut.

As shown in FIG. 2, one pair of restriction rollers 14 and one associated auxiliary roller 15 are disposed between the outer circumference of each nut segment 13 and the circumferential wall 12*b* of the cover 12. More specifically, the one pair of the restriction rollers 14 and the one auxiliary roller 15 are positioned between one of the engaging projections 12*c* and the engaging projection 13*c* of each nut segment. In this representative embodiment, each of the restriction rollers 14 has a cylindrical configuration and has a diameter of 5 mm, for example. Each of the auxiliary rollers 15 also has a cylindrical configuration and has a diameter of 4.5 mm. The diameters am not limited to any specific size, such as 4.5 mm but may be any different size appropriate for the application, such as 4.0 mm.

One end of each auxiliary roller 15 is fitted into one of the guide recesses 11*d* of the base 11. Therefore, each auxiliary roller 15 is retained such that each auxiliary roller 15 can move along the outer peripheral portion of the corresponding nut segment 13 within a movable range limited by the guide recess 11*d*.

Compression coil springs 16 are disposed at tri-sectional positions in the circumferential direction, where no restriction rollers 14 and no auxiliary roller 15 are positioned. Each compression coil spring 16 is interposed between one of the engaging projections 12*c* of the cover 12 and an engaging projection 13*c* of one of the nut segments 13. Therefore, the cover 12 is biased in a clockwise direction as viewed in FIG. 2 (i.e., the fastening direction of the fastening nut 10). Consequently, a pair of the restriction rollers 14 and a single auxiliary roller 15, positioned between each engaging projection 12*c* of the cover 12 and the engaging projection 13*c* of each nut segment 13, are forced to be clamped therebetween. For the purposes of explanation, a circumferential space defined between each engaging projection 12*c* of the cover 12 and the engaging projection 13*c* of each nut segment 13, used for positioning the pair of restriction rollers 14 and an auxiliary roller 15, will be hereinafter called "roller accommodating region R." In addition, a circumferential space defined between one of the engaging projections 12*c* of the cover 12 and the engaging projection 13*c* of one of the nut segments 13, used for positioning the compression coil spring 16, will be herein after called "spring accommodating region B."

In the state shown in FIG. 2, due to the biasing forces of the compression coil springs 16, the cover 12 is positioned at the most right-hand position relative to the base 11. Each roller accommodating region R has the shortest possible length in the circumferential direction and each spring accommodating region B has the longest possible length in the circumferential direction. Therefore, the pair of the restriction rollers 14 and the auxiliary roller 15 are clamped between each engaging projection 12*c* of the cover 12 and the engaging projection 13*c* of each nut segment 13, and are prevented from moving in a circumferential direction. In addition, in this configuration the pair of the restriction rollers 14 does not engage with the relief recesses 13*b* of a corresponding nut segment 13. Therefore, the pair of the restriction rollers 14 is clamped between the circumferential 12*b* of the cover 12 and the outer peripheral surface (other than the relief recess 13*b* portions) of the corresponding nut segment 13. As a result, the nut segments 13 are forced in a direction so as to reduce the overall diameter of the female threaded portion S. This results in the condition that the nut segments 13 are prevented from moving in the radially outward direction. This configuration will hereinafter be called the "fastening-lock condition" of the fastening nut 10.

In the fastening-lock condition, the fastening nut 10 may be engaged with and fastened onto the male threaded portion 3*b*. The fastening nut 10 can be rotated relative to the male threaded portion 3*b* while the pair of the restriction rollers 14 and the auxiliary roller 15 are clamped between each engaging projection 12*c* of the cover 12 and the engaging projection 13*c* of each nut segment 13, so as to be integrated with the cover 12 and the corresponding nut segment 13.

Figure 6:
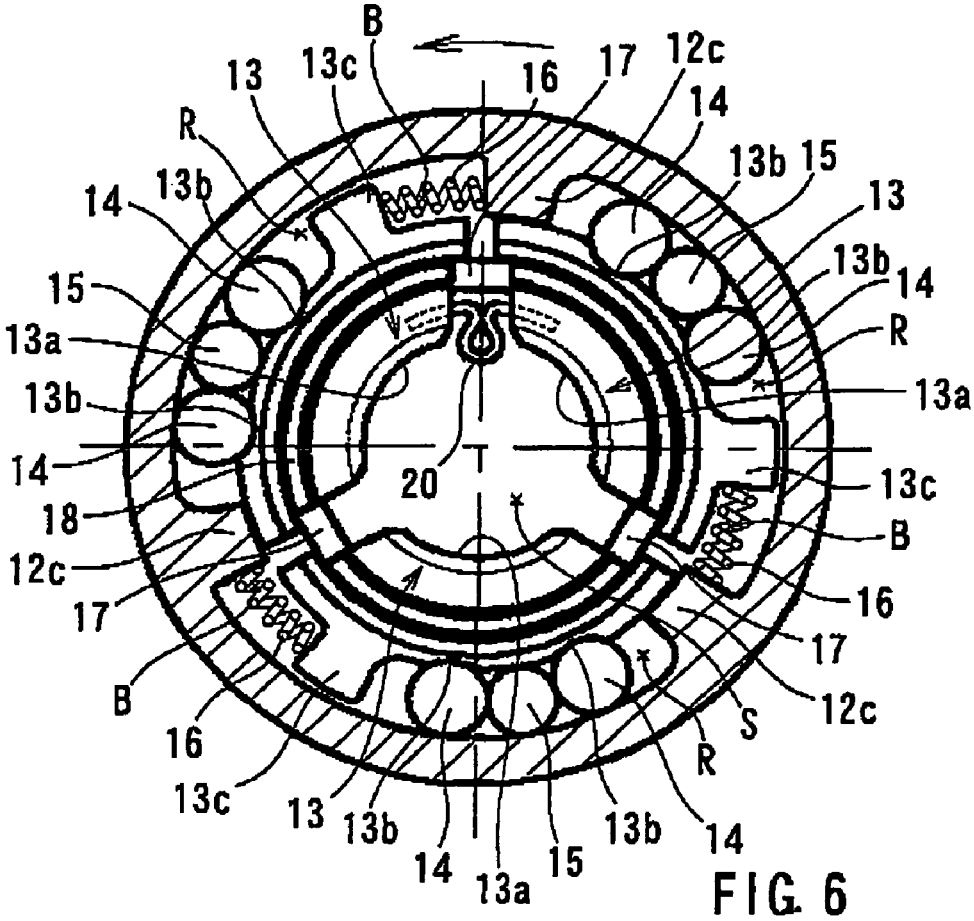
FIG. 6 is a plan view showing the internal structure of the fastening nut in the fastening-unlock position.

Conversely, when the cover 12 has been rotated in a counterclockwise direction (the loosening direction of the fastening nut 10) as indicated by an arrow B in FIG. 6, each of the engaging projection 12*c* moves relative to the related engaging projection 13*c*. Each resulting roller accommodating region R may have the longest possible length in the circumferential direction and each spring accommodating region B may have the shortest possible length in the circumferential direction. In this configuration, the pair of the rest on rollers 14 and the auxiliary roller 15 in each roller accommodating region R can move in the circumferential direction. The pair of the restriction rollers 14 in each roller accommodating region R may then respectively engage with the relief recesses 13*b*. Therefore, each of the nut segments 13 may be permitted to move radially outward by a slight distance (approximately 0.1 mm in this representative embodiment). As a result, the fastened state of the nut segment 13 with the male threaded portion 3*b* may be loosened or released. This condition will hereinafter be called the "fastening-unlock" condition.

As described above, in the fastening-lock condition shown in FIG. 2, the compression coil springs 16 force the cover 12 to be positioned at the right-most position relative to the base 11, this may rest in the roller accommodating regions R having the shortest length in the circumferential direction, restraining the radially outward movement of the nut segments 13. Therefore, the fastening nut 10 may be locked in the fastened condition with the male threaded portion 3*b* of the spindle 3. Conversely, when the cover 12 is rotated in the left-hand direction against the biasing forces of the compression coil springs 16, the result may be the fastening-unlock condition shown in FIG. 6. In this condition, the roller accommodating regions R may have the longest length in the circumferential direction in order to permit the radially outward movement of the nut segments 13. Therefore, the fastening condition of the fastening nut 10 with the male threaded portion 3*b* of the spindle 3 may be released. As a result, it is possible to rotate the fastening nut 10 relative to the male threaded portion 3*b* of the spindle 3 in the loosening direction via a relatively small force.

As shown in FIGS. 2 and 6, a seal member 17 made of rubber for example, is inserted into the gap formed between each of two circumferentially adjacent nut segments 13. Thus, three seal members 17 are provided in this representative embodiment. The position of each seal member 17 is chosen so as to not interact with or restrict the movement of the nut segments 13 in the radial direction. Since the seal members 17 block the circumferential gaps between the nut segments 13, foreign particles may not enter from the female threaded portion S into the spring accommodating regions B or into the roller accommodating regions R. Therefore, situations can be avoided involving foreign particles causing potential malfunction of the fastening nut 10.

Figure 3:
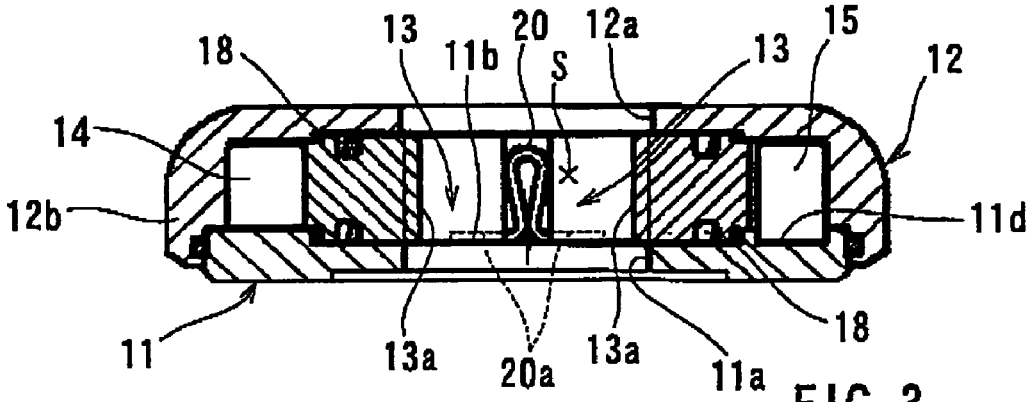
FIG. 3 is a cross-sectional view taken along line III—III in FIG. 2, showing a vertical sectional view of the fastening nut in the fastening-lock position.
Figure 4:
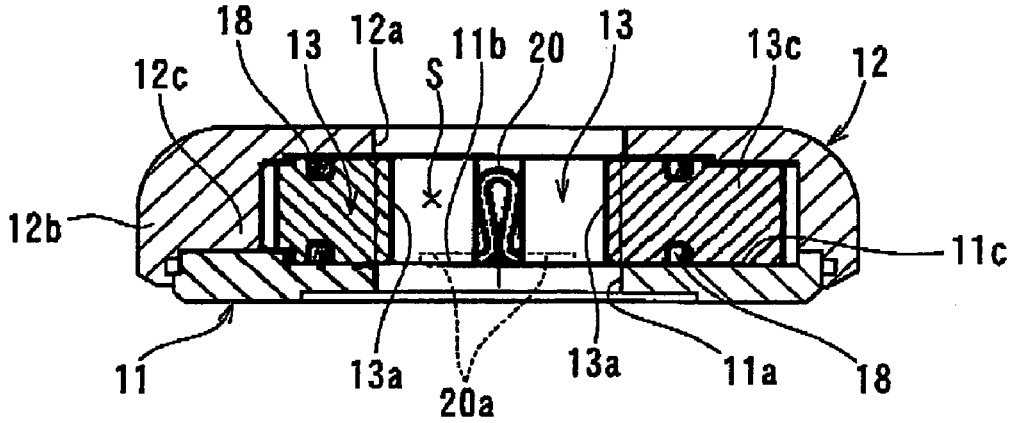
FIG. 4 is a cross-sectional view taken along line IV—IV in FIG. 2, showing another vertical sectional view of the fastening nut.
Figure 5:
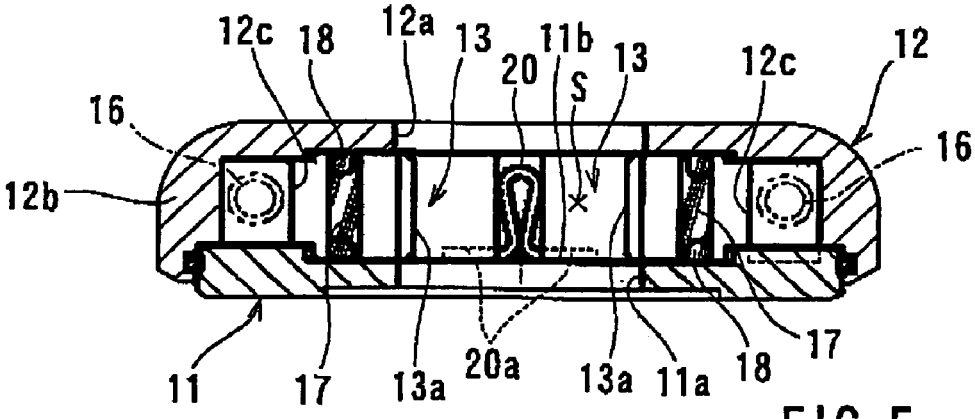
FIG. 5 is a cross-sectional view taken along line V—V in FIG. 2, showing another vertical sectional view of the fastening nut.

As shown in FIGS. 3 to 5, three seal rings 17 are integrally joined to each other at their respective upper portions and lower portions via annular seal rings 18. One of the seal rings 18 is clamped between the nut segments 13 and the base 11. The other of the seal rings 18 is clamped between the nut segments 13 and the cover 12. Therefore, the seal rings 18 may respectively provide a seal between the nut segments 13 and the base 11 and a seal between the nut segments 13 and the cover 12.

A stopper is inserted into the circumferential gap between two of the nut segments 13 in order to inhibit the insertion of the male threaded portion 3*b* into the fastening nut 10 in an inappropriate direction. If the representative fastening nut 10, including the loosening assist function as described above, were engaged and fastened onto the male thread 3*b* by initially inserting the male threaded portion 3*b* into the insertion hole 12*a* of the cover 12, and not by initially inserting the male threaded portion 3*b* into the insertion hole 11*a* of the base 11, the cover 12 may be rotated relative to the base 11 in a direction so as to increase the circumferential length of the roller accommodating regions R (and subsequently actuating the loosening assist function) during the fastening operation. Conversely, during an attempted loosening operation, the cover 12 may be rotated in a direction so as to reduce the circumferential length of the roller accommodating regions R (resulting in the fastening-lock condition). These rotating directions are opposite to the rotating directions necessary for correctly implementing the loosening assist function as described above. As a result, the loosening assist function may not be at all effective if the fastening nut 10 is assembled improperly. For this reason, a stopper 20 is provided in order to inhibit such improper fastening operation due to the installation of the fastening nut 10 in an upside down orientation as compared to the orientation required for the normal fastening operation.

Figure 12:
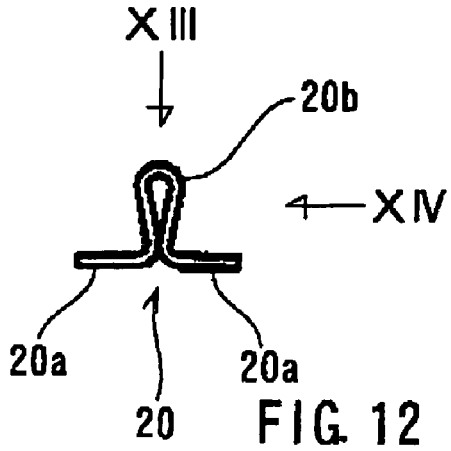
FIG. 12 is an individual view of a stopper of the fastening nut from a direction perpendicular to the nut axis.

The stopper 20 is exclusively shown in FIG. 12 and is formed by a steel wire that has been bent so as to enable resilient deformation. The stopper 20 has an engaging portion 20*b* adapted to extend radially inwardly beyond the inn diameter of the nut segments 13 (i.e., inside of the face threaded portion S). The stopper 20 also has two legs 20*a* respectively extending in the right and left directions from the lower end of the engaging portion 20*b*, as viewed in FIG. 12. As shown in FIGS. 2 to 5, one of the legs 20*a* is clamped between one of two adjacent nut segments 13 and the base 11. The other of the legs 20*a* is clamped between the other of two adjacent nut segments 13 and the base 11. With the legs 20*a* thus clamped, one end of the engaging portion 20*b* on the side opposite to the legs 20*a* extends into the space within the female threaded portion S.

Figure 13:
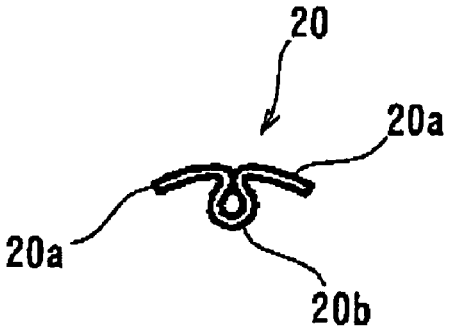
FIG. 13 is a view of the stopper as viewed in the direction of arrow XIII in FIG. 12 along the nut axis, showing a plan view of the stopper.
Figure 14:
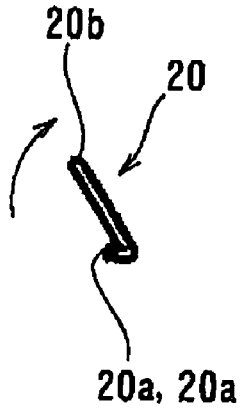
FIG. 14 is a view of the stopper as viewed in the direction of arrow XIV in FIG. 12, perpendicular to the nut axis and perpendicular to FIG. 12, showing a side view of the stopper.
Figure 15:
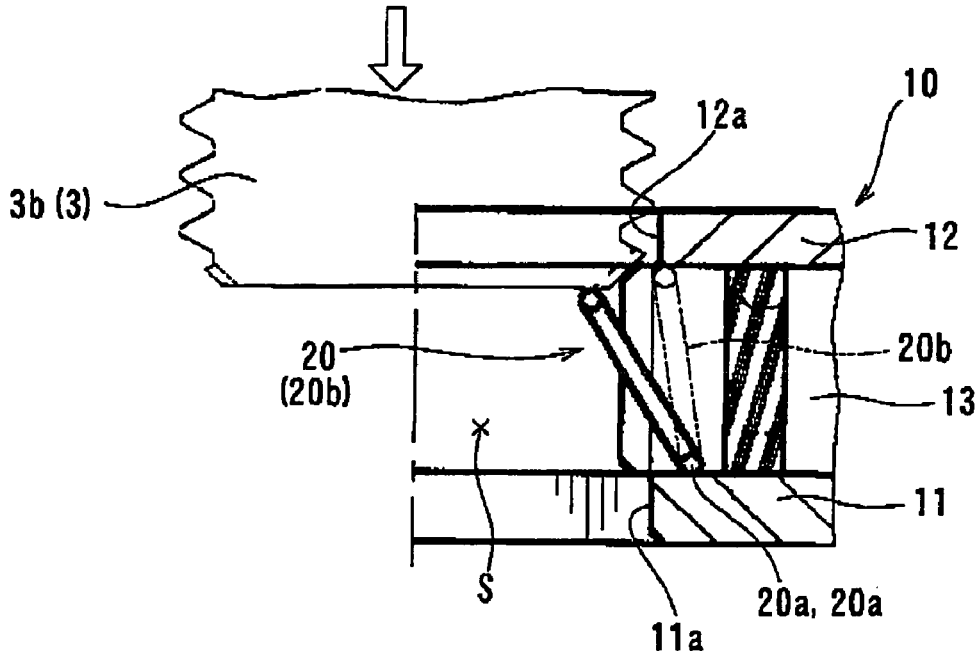
FIG. 15 is a vertical sectional view of the fastening nut and illustrating the operation of the stopper when a male threaded portion is inserted into the female threaded portion of the fastening nut from the side of the cover.
Figure 16:
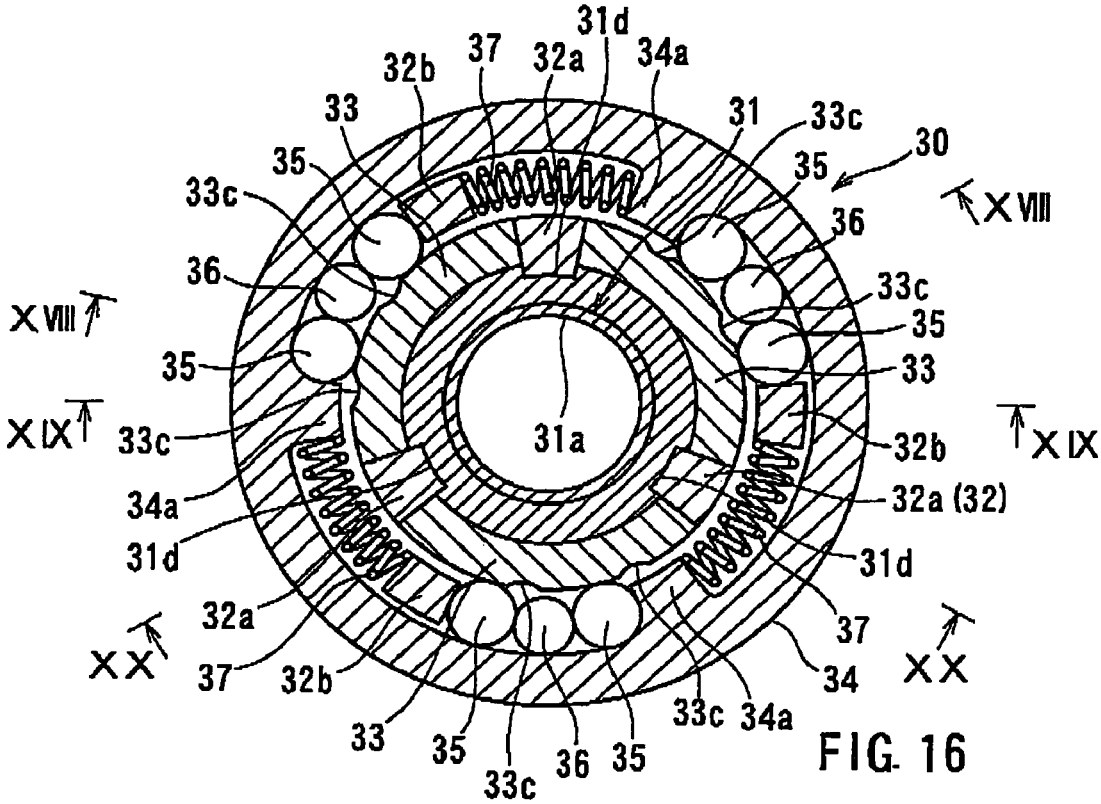
FIG. 16 is a plan view of the internal structure of a fastening nut according to a second representative embodiment, showing the state where an operation member is turned to a fastening side.

As shown in FIG. 13, the legs 20*a* are slightly curved to have an arc-shaped configuration in plan view. Therefore, when the legs 20*a* are clamped between the nut segments 13 and the base 11, the stopper 20 may be inhibited or prevented from rotating about either of the legs 20*a*. In addition, the engaging portion 20*b* may be positioned and held such that the protruding distance of the engaging portion 20*b*, into the space within the female threaded portion S, gradually increases in a direction form the side of the insertion hole 11*a* of the base 11 towards the side of the insertion hole 12*a* of the cover 12. Thus, the engaging portion 20*b* may be held to be inclined upward toward the space within the female threaded portion S, as shown in FIG. 15. Further, the engaging portion 20*b* can be resiliently held in the inclined position (hereinafter also called a "restricting position"), since the curved legs 20*a* are clamped between the nut segments 13 and the base 11.

As the male threaded portion 3*b* is inserted into the female threaded portion S, the male threaded portion 3*b* may press the engaging portion 20*b* of the stopper 20 so as to pivot the engaging portion 20*b* from a restricting position, where the stopper 20 extends into the female threaded portion S as indicated by the solid lines in FIG. 15, towards an upright position, against the biasing force of the engaging portion 20*b*. As a result, the engaging portion 20*b* may be turned aside to a withdrawal position where the engaging portion 20*b* does not extend into the female treaded portion S as indicated by chain lines in FIG. 15. In other words, the engaging member 20*b* may be entirely withdrawn into the gap between the two segment nuts 13 so as to not substantially interfere with the continued insertion of the threaded portion 3*b*.

In proper operation, the male threaded portion 3*b* of the spindle 3 is inserted from the side of the insertion hole 11*a* of the base 11 (i.e., the lower side as viewed in FIG. 1). Then, the fastening nut 10 is engaged with and fastened onto the male threaded portion 3*b* by rotating the fastening nut 10 in the fastening direction. During the process of fastening the fasting nut 10 by inserting the male threaded portion 3*b* from the side of the insertion hole 11*a*, the front end of the male threaded pardon 3*b* may press the engaging portion 20*b* of the stopper 20, applying a force against the resilient force of the stopper 20. As a result, the engaging portion 20*a* may be gradually pivoted from a restricting position, indicated by solid lines in FIG. 15, to the withdrawn position indicated by chain lines in FIG. 15. Therefore, in the case of proper operation, the stopper 20 does not serve to inhibit the insertion of the male threaded portion 3*b* into the female threaded portion S.

Alternatively, in the event that the male threaded portion 3*b* is oriented so as to be inserted into the finale treaded portion S from the side of the insertion hole 12*a* of the cover 12, as indicated by an outline arrow in FIG. 15, the front end of the male threaded portion 3*b* may come in contact with one end of the engaging portion 20*b* of the stopper 20 and may subsequently be prevented from moving any further. Therefore, in this case, the stopper 20 may serve to inhibit the insertion of the male threaded portion 3*b* into the female threaded portion S in a direction opposite to the proper direction.

In this way, as long as the fastening nut 10 is engaged with and fastened onto the male threaded portion 3*b* of the spindle 3 while the male threaded portion 3*b* is oriented such that that the male threaded portion 3*b* is first inserted into the insertion hole 11*a* of the base 11, the engaging portion 20*b* of the stopper 20 is pressed by the male threaded portion 3*b* so as to be withdrawn from inside of the female threaded portion S. Therefore, the iron of the male threaded portion 3*b* into the female threaded portion S and the subsequent fastening operation of the fastening nut 10 may be performed without interference. Conversely, in the event that the male threaded portion 3*b* is moved such that the male threaded portion 3*b* is first inserted into the insertion hole 12*a* of the cover 12, the engaging portion 20*b* of the stopper 20 is pressed by the male threaded portion 3*b* so as to slightly extend further inside of the female threaded portion S. Consequently, further insertion of the male threaded portion 3*b* into the female threaded portion S may be inhibited. The result is that the fastening nut 10 may be prevented from being improperly fastened onto the male threaded portion 3*b*.

As described above, the fastening nut 10 may be completely fastened onto the male threaded portion 3*b* of the spindle 3 only if the male threaded portion 3*b* has been inserted from the side of the insertion hole 11*a* of the base 11. An improper inserting operation of the male threaded portion 3*b* in a direction opposite to the proper don can be reliably inhibited. Therefore, the rotation of the cover 12 in the fastening-unlock direction relative to the base 11 reliably implements the loosening assist function. The loosening assist friction enables the radially outward displacement of the nut segments 13. This releasing the condition where the nut segments 13 are pressed against the male threaded portion 3*b* in the radially inward direction toward the center of the female red portion S.

By utilizing the representative fastening nut 10 described above, the grinding wheel 2 may be mounted to the spindle 3 by the following steps: (1) fitting the grinding wheel 2 onto the spindle 3 until the grinding wheel 2 contacts the flange 3*a* of the spindle 3, where the grilling wheel 2 is fitted in such a manner that the male threaded portion 3*b* of the spindle 3 is inserted into the mounting hole 2*a* of the grinding wheel 2, as shown in FIG. 1; and (2) fastening the fastening nut 10 onto the male threaded portion 3*b*.

In the fastened condition of the fastening nut 10, each pair of restriction rollers 14 stably prevents the corresponding nut segments 13 form moving in a radially outward direction. Therefore, it is possible to more reliably and stably prevent the movement of the nut segments 13 in comparison with the conventional construction utilizing only a single ball (or roller). In addition, the fastening nut 10 can smoothly rotate in the fastening direction (i.e., right-hand direction) and the loosening direction (i.e., left-hand direction) because the potential movement in the radial direction of the nut segments 13 relative to the fastening nut 10 is reliably prevented.

Further, stopper 20 of the representative fastening nut 10 ensures that the fastening nut 10 is fastened onto the male threaded portion 3*b* with the proper orientation of the fastening nut 10 relative to the male threaded potion 3*b*. Thus, in order to fasten the fastening nut 10 onto the male treaded portion 3*b*, the fastening nut 10 may easily be fitted onto the male threaded portion 3*b* from the side of the insertion hole 11*a* of the base 11, and may then be rotated in the right-hand direction. As the male threaded portion 3*b* is inserted into the fastening nut 10 from the side of the insertion hole 11*a* of the base 11, the male threaded portion 3*b* presses the stopper 20 and moves the stopper 20 so as to withdraw the stopper 20 from the female threaded portion S. Consequently, the male threaded portion 3*b* can smoothly engage the fastening nut 10, i.e., the female threaded portion S. Conversely, in the event that the male threaded portion 3*b* is inserted into the fastening nut 10 from the side of the insertion hole 12*a* of the cover 12, the male threaded portion 3*b* presses the stopper 20 so as to tilt the stopper 20. The stopper 20 then further extends into the female threaded portion S so that the male threaded portion 3*b* may not readily move further into the female headed portion S. The fastening nut 10 may therefore be prevented from being completely fastened onto the male threaded portion 3*b* in an attempt to clamp the grinding wheel 2. As a result, the stopper 20 ensures that the fastening nut 10 is always fastened onto the male threaded portion 3*b* with the fastening nut 10 oriented in a correct direction. Therefore, the fastening nut 10 can be reliably brought to the fastening-unlock condition in order to loosen the fastening nut 10 from the male threaded portion 3*b*. Consequently, the fastening nut 10 can reliably implement the loosening assist function.

Figure 24:
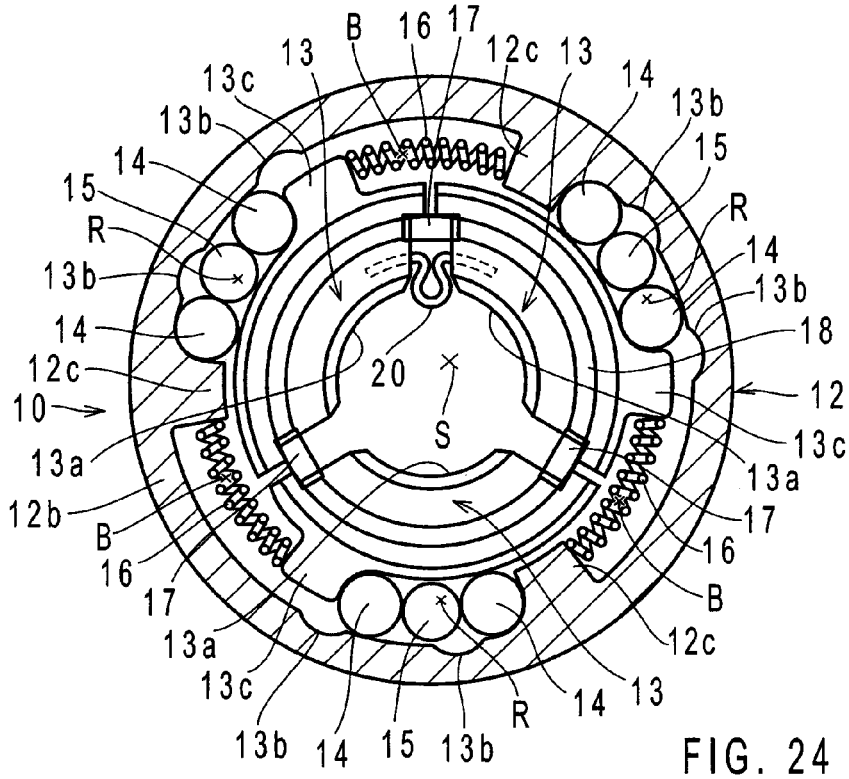
FIGS. 24 and 25 are plan views of the internal structure of a fastening nut according to the first representative embodiment, showing relief recesses in the cover.
Figure 25:
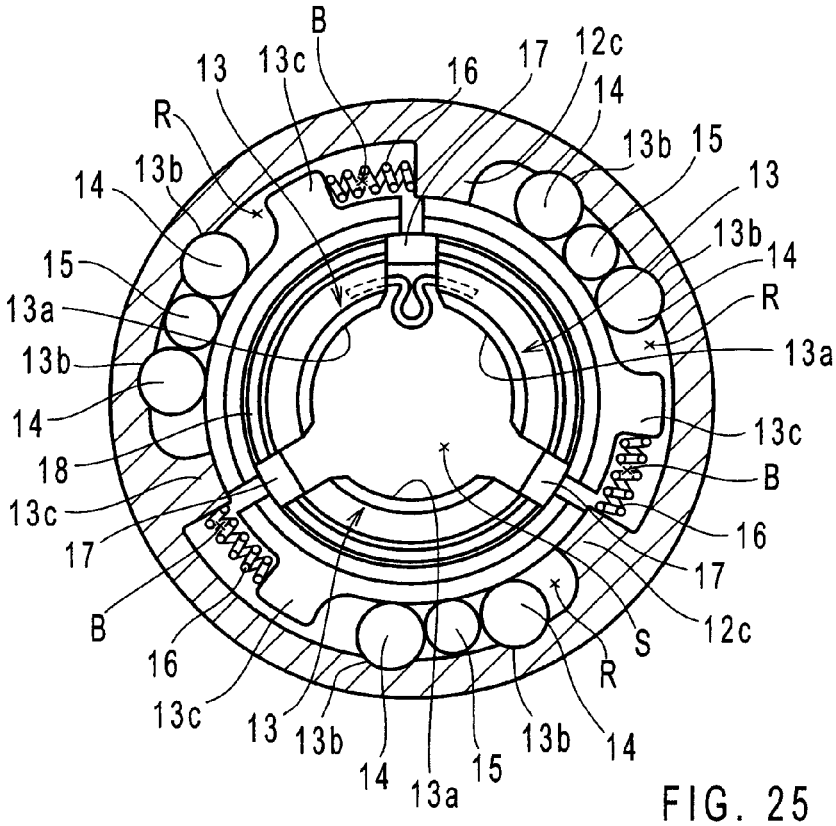

The first representative embodiment described above may be modified in various ways. For example, although the pair of the restriction rollers 14 are incorporated in order to prevent the corresponding nut segment 13 from moving in the radially outward direction, three or more restriction rollers may be used for this purpose. In addition, although the restraining rollers 14 and the auxiliary rollers 15 have cylindrical configurations, they may have spherical configurations. Further, although the relief recesses 13*b* are formed in each nut segment 13, the relief recesses 13*b* may be formed in the circumferential wall 12*b* of the cover 12 (see, e.g., FIGS. 24 and 25). Furthermore, the stopper 20 may be eliminated if desired. Although the fastening nut 10 has been described in connection with an application for fixing a grinding wheel 2 to the spindle 3 of a grinder 1, the fastening nut 10 nay be applied to any other purpose, such as applications in combination with conventional fastening bolts or screws and in combination with anchor bolts used for installation of various machines and apparatus.

Second Representative Embodiment

A second representative embodiment will now be described with reference to FIGS. 16 to 21. In the first representative embodiment described above, the three nut segment 13 constituting a single viral nut to be fastened onto the male threaded portion 3*b* of a spindle 3 are moved in the radial direction in order to lock and release a fastened condition. A fastening nut of the second representative embodiment utilizes wedge members that function so as to press a pressing flange in an axial direction of a male threaded portion against an object (e.g., a grinding wheel 2) to be fixed in position in order to establish the fastening condition of the nut. Therefore, the fastening nut of the second representative embodiment is configured as a wedge type fastening nut.

Referring to FIGS. 16 to 21, the fastening nut 30 has a nut body 31 that includes a female threaded potion 31*a* and a flange portion 31*b*. The female threaded portion 31*a* is adapted to be fastened onto the male threaded portion 3*b* of the spindle 3 as described in connection with the first representative embodiment. The flange portion 31*b* extends radially outward from a first end in an axial direction of the female treaded portion 31*a*. A pressing flange 32 and a plurality of wedge members 33 (three wedge members are provide in this representative embodiment) are positioned on the outer peripheral side of the nut body 31. In this embodiment, the female threaded portion 31*a* is configured as a right-hand thread corresponding to the male treaded portion 3*b*.

The pressing flange 32 is positioned on a second side (opposite to the first side) of the female threaded portion 31*a* and opposes the flange portion 31*b* in the axial direction. Three restricting portions 32*a* extend axially from the inner wall (i.e., the upper wall as viewed in FIGS. 18 to 21) towards the flange portion 31*b*. The restricting portions 32*a* are positioned at tri-sectional positions along die circumferential direction. Inner peripheral side parts of the restricting portions 32*a* respectively axially slidably engage guide recesses 31*d* formed in the outer peripheral surface of the nut body 31. Therefore, the pressing flange 32 can move relative to the nut body 31 in a direction parallel to the axial direction of the nut body 31, but the pressing flange 32 rotates together with the nut body 31. In other words, the pressing flange 32 and the nut body 31 always rotate in unison with each other.

As shown in FIGS. 18 to 21, a seal ring 38 is interposed between the inner peripheral surface of the pressing flange 32 and the outer peripheral surface of the nut body 31. The seal ring 38 prevents foreign particles from entering a space defined between the flange portion 31*b* of the nut body 31 and the pressing flange 32. A stopper ring (not shown) may be provided in order to prevent the pressing flange 32 from being removed from the nut body 31.

The wedge members 33 are radially movably disposed between the flange portion 31*b* of the nut body 31 and the pressing flange 32. The wedge members 33 are positioned at tri-sectional positions in the circumferential direction about the axis of the female threaded portion 31*a*. Each of the wedge members 33 has first and second inclined surfaces 33*a* and 33*b* formed on opposite sides in the direction of thickness (i.e., the axial direction). The first inclined surface 33*a* of the wedge members 33 slidably contacts with an inclined surface 31*c* formed on the inner wall of the flange portion 31*b* of the nut body 31. The inclined surface 31*c* may be formed throughout the circumferential length of the inner wall. The second inclined surface 33*b* of the wedge members 33 respectively slidably contacts with inclined surfaces 32*c* formed on the inner wall of the pressing flange 32*c*. Therefore when the wedge members 33 move radially inward, the pressing flange 32 moves in an axial direction away from the flange portion 33*b* so as to be pressed against the grinding wheel 2 (i.e., the object to be fixed in position). As a result, threads of the female threaded portion 31*a* are pressed against the threads of the male threaded portion 3*b* in the axial direction, locking the fastened condition of the fastening nut 30 onto the male threaded portion 3*b*.

Each of the restricting portions 32*a* of the pressing flange 32 is positioned between each adjacent wedge members 33. Therefore, the restricting portions 32*a* prevent the wedge portions 33 from moving in a circumferential direction.

Figure 17:
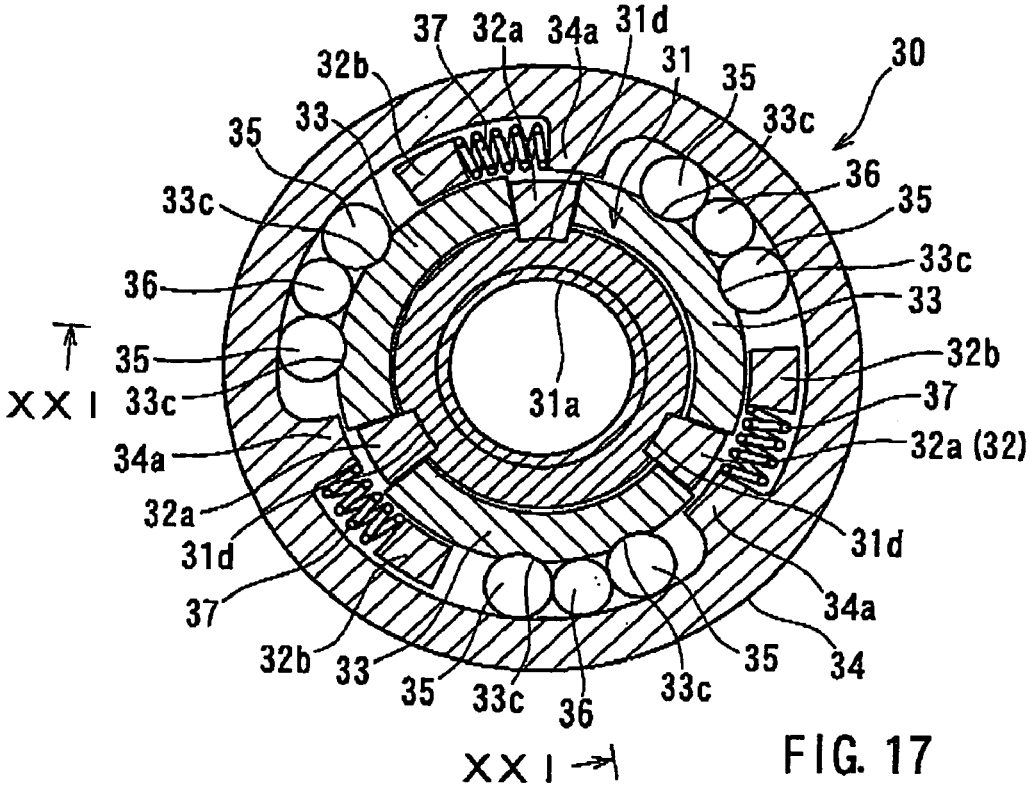
FIG. 17 is a plan view similar to FIG. 16 but showing the operation where the operation member is rotated toward a loosening side against the biasing forces of the comparison coil springs.

Similar to the nut segments 13 of the fast representative embodiment, two relief recesses 33*c* are formed in the outer peripheral surface of each of the wedge portions 33. Each of the relief recesses 33*c* has an arc-shaped configuration in cross-section and has a depth of about 1 mm. As shown in FIG. 17, each relief recess 33*c* serves to receive a part of a corresponding restriction roller 35 that will be hereinafter described.

An annular operation member 34 is assembled to enclose the wedge members 33 from the outer peripheral side. As shown in FIGS. 18 to 21, the flange portion 31*a* of the nut body 31 and the pressing flange 32 ar disposed on the inner side of the operation member 34.

A pair of restriction rollers 35 and an auxiliary roller 36 are disposed between the operation member 34 and each of the wedge members 33. The auxiliary roller 36 is positioned between the restriction rollers 35 in the circumferential direction and serves to define a possible minimum distance between the restriction rollers 35. The distance between the restriction rollers 35 (i.e., the distance between the centers of the restriction rollers 35) coincides with the distance between the relief recesses 33*c* formed in each wedge member 33. Therefore, the restriction rollers 35 may simultaneously engage with or disengage from the corresponding relief recesses 33*c*.

Three engaging projections 34*a* are formed on the inner peripheral wall of the operation member 34 to extend radially inward and to be positioned at this sectional locations along the circumferential direction about the axis of the female threaded portion 31*a*. Three engaging projections 32*b* am formed on the pressing flange 32 and respectively oppose the engaging projections 34*a* along the circumferential direction. A compression coil spring 37 is disposed between each engaging projection 34*a* of the operation member 34 and the corresponding engaging 32*b*, of the pressing flange 32. Therefore, the operation member 32 is biased by the compression coil springs 37 in a right-hand direction (i.e., the fastening direction of the fastening nut 30) relative to the nut body 31 and the pressing flange 32. With this arrangement, in order to engage and fasten the fastening nut 30 onto the male threaded portion 3*b*, the operation member 34 may be rotated in the right-hand direction (clockwise) as viewed in FIG. 16. The rotation of the operation member 34 may be transmitted to the pressing flange 32 via the three groups rollers. Each group of rollers includes a pair of restriction rollers 35 and one auxiliary roller 36, clamped between the corresponding set of engaging projection 34*a* and engaging projection 32*b*. In addition, the operation member 34, the pressing plate 32, and the nut body 31, may rotate in unison with each other in the right-hand direction, since the restricting portions 32*a* of the pressing flange 32 are in engagement with respective guide recesses 31*d* formed in the nut body 31. The fastening nut 30 may be loosened from the male treaded portion 3*b* by rotating the operation member 34 in the left-hand direction (counter clockwise) as shown in FIG. 17.

Figure 18:
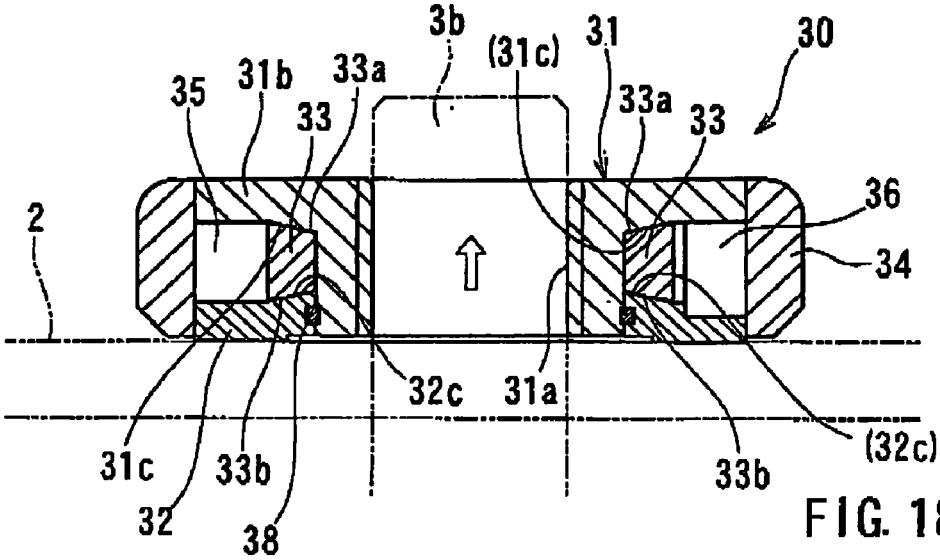
FIGS. 18–20 are vertical sectional views respectively taken along lines XVIII—XVIII, XIX—XIX and XX—XX in FIG. 16 and indicating an inserting direction of the male threaded portion by an outline arrow.
Figure 19:
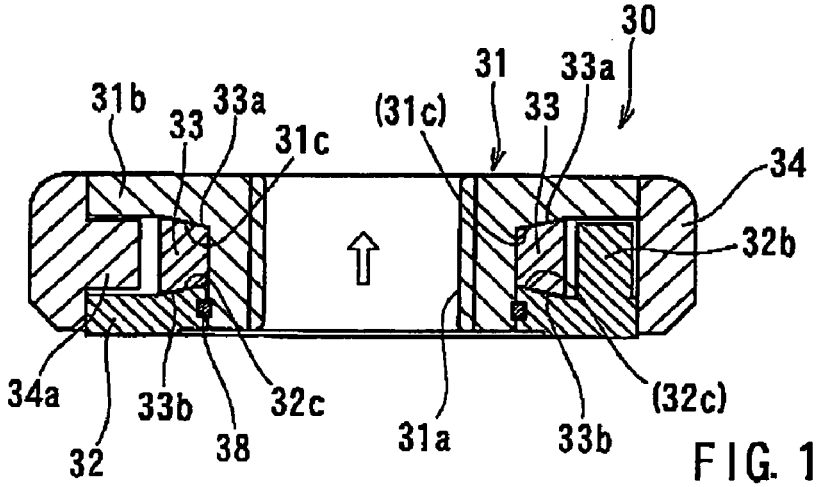
Figure 20:
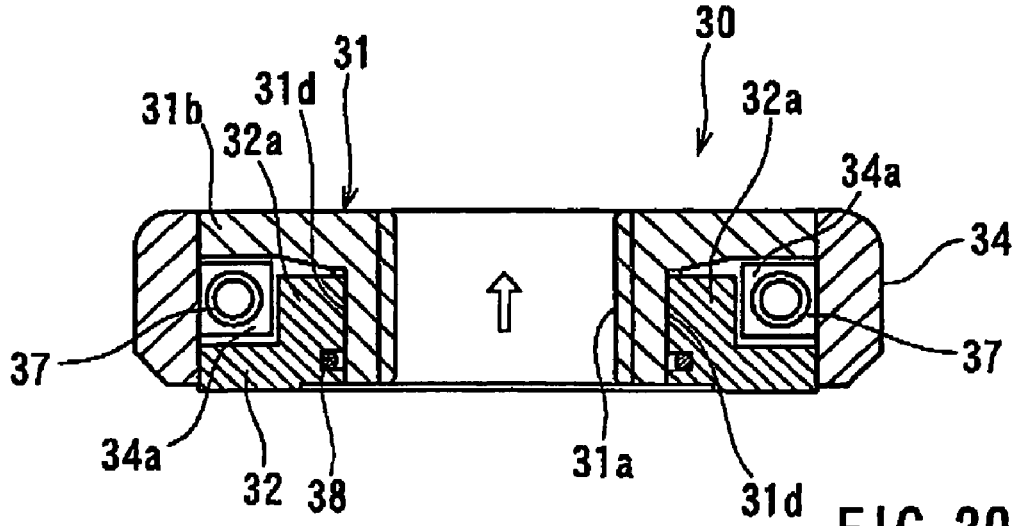
Figure 21:
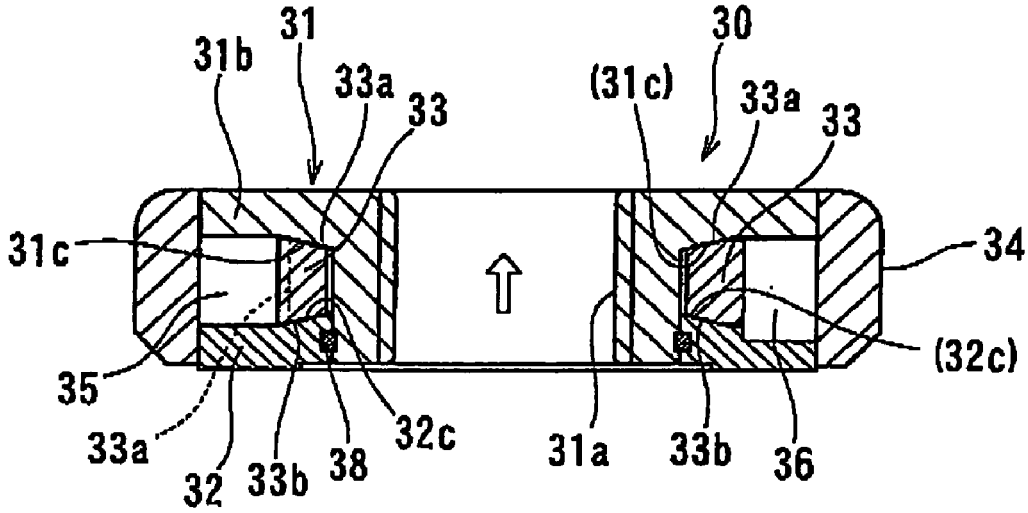
FIG. 21 is a vertical sectional view taken along line XXI—XXI in FIG. 17 and indicating the inserting direction of the male threaded portion by the outline arrow.

In operation, the fastening nut 30 may be fastened onto the male headed portion 3*b* in such a manner that the male threaded portion 3*b* is inserted into the fastening nut 30 from the side of the pressing flange 32, as shown in FIG. 18. During the fastening process, the pressing flange 32 and evenly the nut body 31 rotate with the operation member 34 in the right-hand direction, i.e., the fastening direction, with the pair of the restriction rollers 35 and the auxiliary roller 36 dame between each of the engaging projections 34*a* of the operation member 34 and the corresponding engaging projection 32*b* of the pressing flange 32. In addition, during the fastening process, each of the restriction rollers 35 is positioned so as to not engage the corresponding relief recess 33*c*. Therefore, each of the wedge members 33 is pressed radially inward toward the center of the fine treaded portion 31*a*, so that the pressing flange 32 is held in a position away from the flange portion 31*b* of the nut body 31 in the axial direction.

At the final stage of the fastening process of the fastening nut 30, the pressing flange 32 may be pressed directly against the grinding wheel 2 due to the fastening force attaching the fastening nut 30 onto the male threaded portion 3*b* and due to the wedging actions of the wedge members 33.

As a result, the fastening nut 30 may be fastened onto the male threaded portion 3*b* by a relatively strong force.

In order to loosen the fastening nut 30, the operation member 34 may be rotted in the left-hand direction against the biasing forces of the compression coil springs 37, as shown in FIG. 17. This may cause the rotation of the operation member 34 relative to the pressing flange 32. As a result, each of the engaging projections 34*a* may no longer apply a clamping force to corresponding set of restriction rollers 35 and the auxiliary roller 36. The restriction rollers 35 associated with each wedging members 33 may then respectively engage the corresponding relief recesses 33*c* in order to enable the wedging members 33 to move radially outward. The pressing force applied to the grinding wheel 2 from the pressing flange 32 may be weakened, and consequently, the fastening force applied onto the male threaded portion 3*b* by the fastening nut 30 may also be weakened. In this way, the operation member 34, the pressing flange 32, and the nut body 31, can then be rotated in the loosening direction using a relatively small force, after the operation member 34 has been rotated through a predetermined angle against the biasing forces of the compression coil springs 37, bringing the restriction rollers 35 into engagement with their corresponding relief recesses 33*a*.

As described above the fastening nut 30 according to the second representative embodiment, even in the event that the fastening nut 30 has been excessively fastened onto the male treaded portion 3*b* clue to the resistance applied by the workpiece to the grinding wheel 2 against the rotation of the rotary tool 1, can be easily loosened by applying a relatively small force to the operation member 34, rotating the operation member 34 by a predetermined angle in the loosening direction against the biasing force of the compression coil springs 37. The wedge members 33 may then become free from restriction. Consequently, the pressing force applied to the grinding wheel 2 by the pressing flange 32 may be lessened or released.

In addition, in the fastening nut 30 according to the second representative embodiment, each of the wedge members 33 is arranged in a circumferential about the axis of the male threaded portion 31*a* and is stably prevented from moving in a radial direction by a corresponding pair of restriction rollers 35. Therefore, it is possible to more reliably and stably prevent the movement of the wedge members 33 in comparison with the conventional construction utilizing only a single ball (or roller). In addition, the fastening nut 30 can smoothly rotate in the fastening direction (i.e., right-hand direction) and the loosening direction (i.e., left-hand direction) because the potential movement in the radial direction of the wedge members 33 relative to the fastening nut 30 is reliably prevented.

Figure 22:
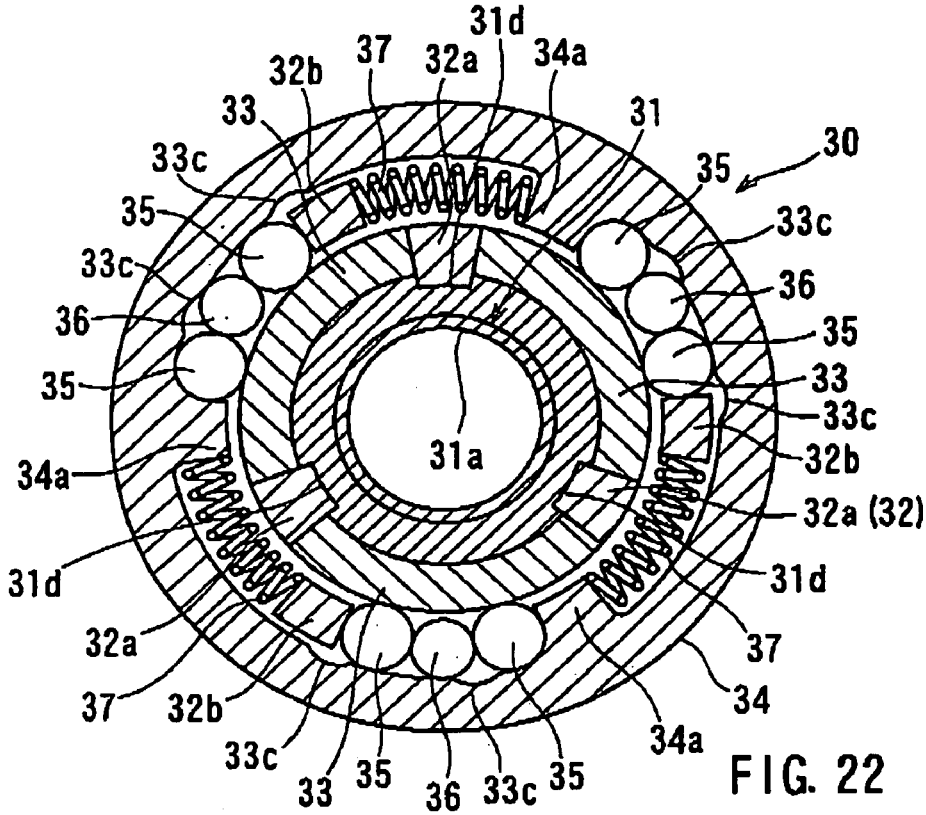
FIGS. 22 and 23 are plan views of the internal structure of a fastening nut according to the second representative embodiment, showing relief recesses in the operations member.
Figure 23:
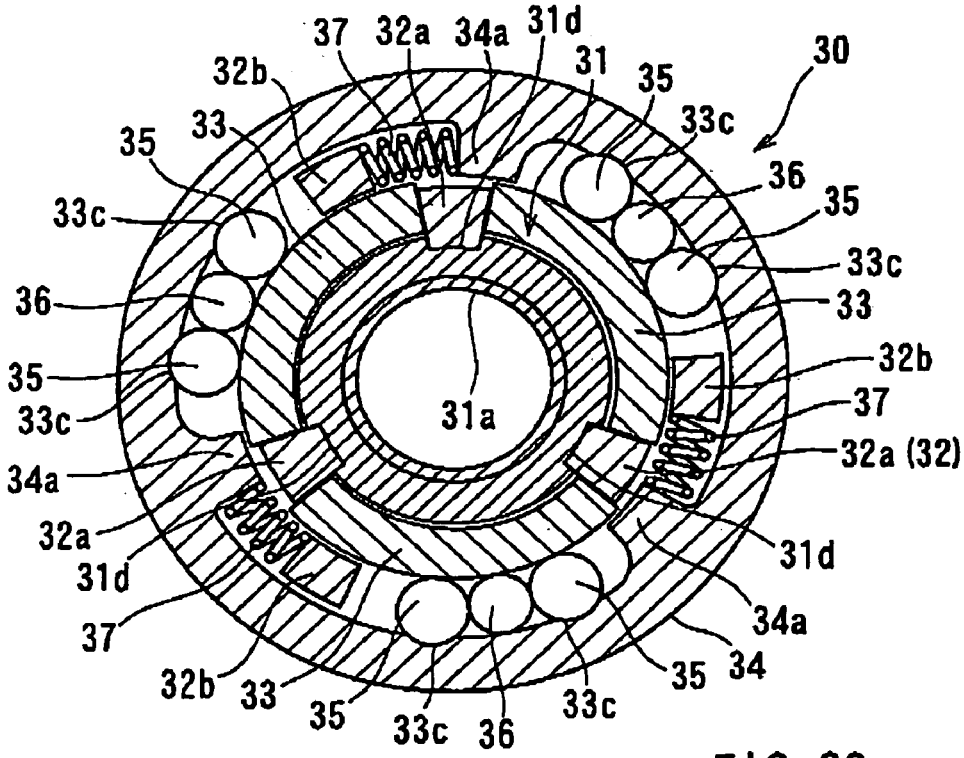

The second representative embodiment described above may be modified in various ways. For example, although a pair of restriction rollers 35 is incorporated for each of the wedge members 33, three or more restriction rollers may be incorporated for each of the wedge members 33. In addition, although the restriction rollers 35 and the auxiliary rollers 36 have cylindrical configurations, the rollers may have spherical configurations. Further, although the relief recesses 33*c* are formed in each wedge member 22, the relief recesses 33*c* may be formed in the inner circumferential surface of the operation member 34 (see, e.g., FIGS. 22 and 23). In addition, although the fastening nut 30 has been described in connection with an application for fixing a grinding wheel 2 to the spindle 3 of the grinder 1, the fastening nut 30 may be applied to any other purposes, such as applications in combination with conventional fastening bolts or screws and in combination with anchor bolts used for installation of various machines and apparatus.

This invention claims:

1. A fastening nut for fastening onto a male threaded member, comprising:

a base having a first insertion hole for receiving the male threaded member;

a cover having a second insertion hole for receiving the male threaded member and having a circumferential wall;

a plurality of nut segments defining a virtual single nut and arranged at regular intervals in a circumferential direction about a nut axis, wherein each of the nut segments is disposed between the base and the cover and is movable in a radial direction with respect to the nut axis;

a plurality of control members corresponding to each nut segment, the control members disposed between each of the nut segments and the circumferential wall of the cover in order to prevent each nut segment from moving in the radially outward direction when the cover is rotated in a nut tightening direction;

a plurality of relief recesses formed in the circumferential wall of the cover for each corresponding nut segment or the plurality of relief recesses formed in each nut segment, wherein the relief recesses are engageable with the corresponding control members to permit each nut segment to move in the radially outward direction when the cover has rotated in a nut loosening direction relative to the base.

2. The fastening nut as in claim 1, further comprising an auxiliary member disposed at least between two adjacent control members for each corresponding nut segment.

3. The fastening nut as in claim 1, further comprising at least one spring arranged and constructed to normally bias the cover in the nut fastening direction relative to the base.

4. The fastening nut as in claim 1, wherein each of the control members is configured as a cylindrical roller, and wherein each of the cylindrical roller has a longitudinal axis extending substantially parallel to the nut axis in an assembled configuration.

5. The fastening nut as in claim 1, further comprising a stopper device arranged and constructed to permit insertion of the male threaded member from one side of the fastening nut and to inhibit insertion of the male threaded portion from another side of the fastening nut.

6. The fastening nut as in claim 1, further comprising a seal device interposed between adjacent nut segments positioned along the circumferential direction.

7. The fastening nut as in claim 6, wherein the seal device comprises a seal member having two ring portion and a plurality of connecting portions connecting between the ring portions, wherein the ring portions and the connecting portions are formed integrally with each other;

wherein one of the ring portions is clamped between the base and the nut segments;

wherein the other of the ring portions is clamped between the cover and the nut segments; and wherein each of the connecting portions is clamped between adjacent nut segments along the circumferential direction.

8. A rotary tool comprising the fastening nut as in claim 1, wherein the male threaded member comprises a motor-driven spindle and wherein the fastening nut is operable so as to fix a rotary blade in position relative to the spindle.

9. A fastening nut for fastening onto a male threaded member, comprising:

a nut body having a female threaded portion and a flange portion, wherein the female threaded portion has a nut axis, and wherein the flange portion extends radially outward from a first axial end of the female threaded portion;

a pressing flange disposed opposing the flange portion of the nut body proximate to a second axial end of the female threaded portion and movable in an axial direction relative to the nut body;

a plurality of wedge members arranged at regular intervals along a circumferential direction about the nut axis and each interposed between the pressing flange and the flange portion of the nut body;

an operation member having a circumferential wall disposed on an outer circumferential circumferential side of the wedge members and enclosing the flange portion of the nut body and the pressing flange;

a plurality of control members corresponding to each of the wedge members, the control members interposed between the operation member and each wedge member in order to prevent each wedge member from moving in the radially outward direction when the operation member is in a first position; and a plurality of relief recesses formed in the circumferential wall of the operation member for each corresponding wedge member or the plurality of relief recesses formed in each wedge member, the plurality of relief members respectively engageable with the control members for each wedge member when the operation member is in a second position;

wherein two or more of the plurality of control members position each wedge member in a radially inward position so as to produce a wedge function when the operation member is in the first position; and wherein the control members for each wedge member are engaged with the corresponding relief recesses in order to permit each wedge member to move radially outward so as to release the wedge function when the operation member is in the second position.

10. The fastening nut as in claim 9, further comprising an auxiliary member disposed at least between two adjacent control members of the two or more of the plurality of control members for each wedge member.

11. The fastening nut as in claim 9, further comprising at least one spring arranged and constructed to normally bias the operation member to the first position.

12. The fastening nut as in claim 9, wherein each of the control members is configured as a cylindrical roller, and wherein the cylindrical roller has a longitudinal axis extending substantially parallel to the nut axis in an assembled configuration.

13. A rotary tool comprising the fastening nut as in claim 9, wherein the male threaded member comprises a motor-driven spindle, and wherein the fastening nut is operable to fix a rotary blade in position relative to the spindle.

14. A fastening nut for fastening onto a male threaded member, comprising:

an operation member operable by an operator to rotate in a fastening direction and a loosening direction; and a female threaded member defining a nut axis; and a control device coupled between the operation member and the female threaded member; wherein the control device comprises:

a plurality of movable members arranged in a circumferential direction about the nut axis and each movable between a first position and a second position along a radial direction from the nut axis, wherein the first position enables a fastening of the female threaded member onto the male threaded member and the second position enables a loosening of the female threaded member from the male threaded member, and a plurality of control members interposed between the operation member and each movable member, at least two of the plurality of control members corresponding to each movable member;

wherein:

two or more of the plurality of control members prevent the movement of each movable member from the first position to the second position when the operation member rotates in the fastening direction;

the two or more of the plurality of control members permit the movement of each movable member from the first position to the second position when the operation member rotates in the loosening direction.

15. The fastening nut as in claim 14, wherein the control members are arranged in the circumferential direction about the nut axis.

16. The fastening nut as in claim 15, wherein the control device further comprises a plurality of relief recesses formed on one of the operation member or each movable member and engageable with the control members, wherein each movable member is positioned in the first position when the control members are not engaged with the relief recesses, and wherein each movable member is permitted to move from the first position to the second position when the control members are engaged with the relief recesses.

17. The fastening nut as in claim 16, wherein the control device further comprises an auxiliary member disposed at least between two adjacent control members for each movable member in order to limit a possible minimum distance therebetween.

18. The fastening nut as in claim 14, further comprising a biasing device arranged and constructed to normally hold the movable members in the first position.

19. The fastening nut as in claim 14, wherein each of the control members comprises a cylindrical roller, and wherein the cylindrical roller has a longitudinal axis extending substantially parallel to the nut axis.

20. The fastening nut as in claim 14, further comprising a stopper device arranged and constructed to inhibit insertion of the male threaded member into the female threaded member from one side of the fastening nut in the axial direction.

21. The fastening nut as in claim 15, further comprising a seal device interposed between each two movable members positioned adjacent to each other along a circumferential direction about the nut axis.

22. The fastening nut as in claim 14, wherein the movable members comprise the female threaded member.

23. The fastening nut as in claim 14, further comprising a flange member axially movable relative to the female threaded member, and wherein the female threaded member comprises a flange portion, and wherein the flange member opposes the flange portion of the female threaded member in the axial direction; and wherein each movable member comprises a wedge member interposed between the flange member and the flange portion of the female threaded member.

24. A rotary tool, comprising:

the fastening nut as in claim 14, and a motor-driven spindle having a mount flange formed thereon and comprising the male threaded member; and wherein the fastening nut is operable so as to clamp a rotary blade against the mount flange of the spindle.

25. A fastening nut for fastening onto a male threaded member, comprising:

a nut body comprising:

a female threaded portion defining a nut axis and comprising a first axial end and a second axial end; and a flange portion extending radially outward from the first axial end;

a pressing flange slidingly disposed around a section of the female threaded portion proximate to the second axial end;

wherein the pressing flange opposes at least a section of the flange portion in an axial direction and is slidingly movable relative to the nut body in the axial direction;

a plurality of wedge members arranged at regular intervals along a circumferential direction about the nut axis and each of the plurality of wedge members is interposed between the pressing flange and the flange portion;

an operation member having a circumferential wall disposed on an outer circumferential side of the plurality of wedge members and enclosing the flange portion and the pressing flange;

two control members for each corresponding wedge member of the plurality of wedge members;

wherein each of the two control members are interposed between the operation member and the corresponding wedge member;

wherein each of the two control members define a first wedge position for each corresponding wedge member when the operation member is in a first operation position;

two relief recesses corresponding to each of the two control members and formed in the circumferential wall of the operation member or in each of the corresponding wedge members;

wherein each of the two control members define a second wedge position for each corresponding wedge member when the operation member is in a second operation position;

wherein the second wedge position is radially outward of the first wedge position to an extent that each of the two control members are engaged with the corresponding two recesses;

wherein the first wedge position fixes the pressing flange at a first axial distance from the flange portion;

wherein the second wedge position allows the pressing flange to move to a second axial distance from the flange portion;

wherein the first axial distance is greater than the second axial distance.

26. The fastening nut as in claim 25, further comprising an auxiliary member disposed between each of the two control members.

27. The fastening nut as in claim 25, further comprising at least one spring arranged and constructed to bias the operation member to the first position.

28. The fastening nut as in claim 25, wherein each control member is configured as a cylindrical roller comprising a longitudinal axis extending parallel to the nut axis.

29. The fastening nut as in claim 25, wherein the plurality of wedge members is comprised of three wedge members.

30. A rotary tool comprising the fastening nut as in claim 25, wherein the male threaded member comprises a motor-driven spindle, and wherein the fastening nut is operable to fix a rotary blade in position relative to the spindle.

* * * * *